US005346531A

United States Patent [19]

Streets

[11] Patent Number: 5,346,531

[45] Date of Patent: Sep. 13, 1994

[54] SLAG SEPARATOR

[75] Inventor: Frederick T. Streets, Sidney, Ohio

[73] Assignee: Honda of America Mfg., Inc., Ohio

[21] Appl. No.: 64,442

[22] Filed: May 21, 1993

Related U.S. Application Data

[63] Continuation-in-part of Ser. No. 899,372, Jun. 16, 1992, Pat. No. 5,246,483.

[51] Int. Cl.[5] ..... C21C 1/00

[52] U.S. Cl. ..... 75/582; 266/215; 266/232

[58] Field of Search ..... 266/232, 215; 75/582

[56] References Cited

U.S. PATENT DOCUMENTS

| | | | |
|---|---|---|---|
| 3,565,605 | 2/1971 | Vayssiere | 75/46 |
| 3,632,335 | 1/1972 | Worner | 266/215 |
| 3,702,695 | 11/1972 | Rouanet | 266/227 |
| 3,735,010 | 5/1973 | Turpin | 266/232 |
| 4,274,622 | 6/1981 | Ohmori | 266/227 |
| 5,004,495 | 4/1991 | Labate | 75/10.22 |

*Primary Examiner*—Peter D. Rosenberg
*Attorney, Agent, or Firm*—Ronald P. Kananen

[57] ABSTRACT

An apparatus and method are disclosed for receiving molten slag and molten metal or alloy resulting from the smelting of ore from a cupola and for separating the slag from the molten metal or alloy. The slag separator of the present invention includes a refracting lining to protect the separator from the mechanical, chemical and thermal properties of the molten mixture. During the process of separation, the refractory however, suffers from erosion due to the mechanical, chemical and thermal properties of the mixture. A water cooling system is provided including water cooling jackets, provided on the outside of the refractory and surrounding the separation chambers, and water control valves to reduce refractory erosion and greatly increase refractory life. Further, vent holes may be provided in the refractory for venting any water which might leak from the water cooling system. In addition, the separator is provided with two chambers which allow the slag to rise to the top of the metal or alloy. The slag then flows out of the chambers. The use of two chambers greatly increases the purity of the metal or alloy by allowing almost all of the slag to settle out of the metal or alloy.

35 Claims, 9 Drawing Sheets

FIG. 1A
(PRIOR ART)
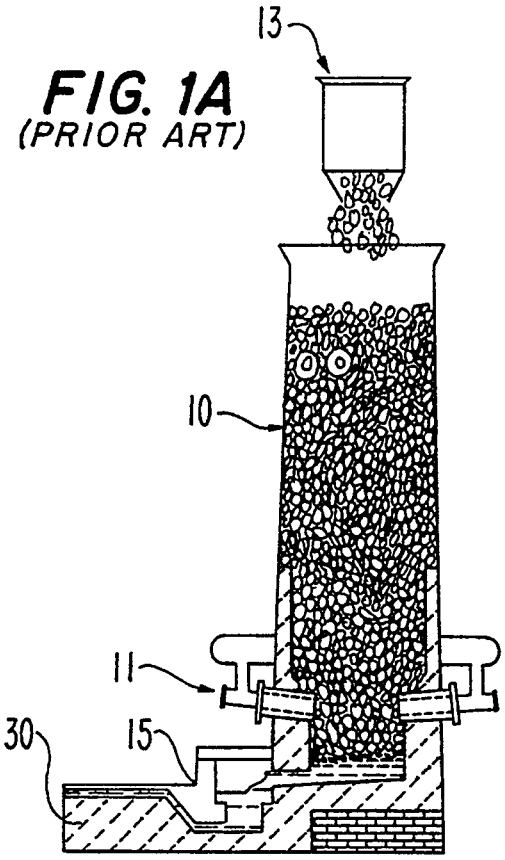
FIG. 1B
(PRIOR ART)
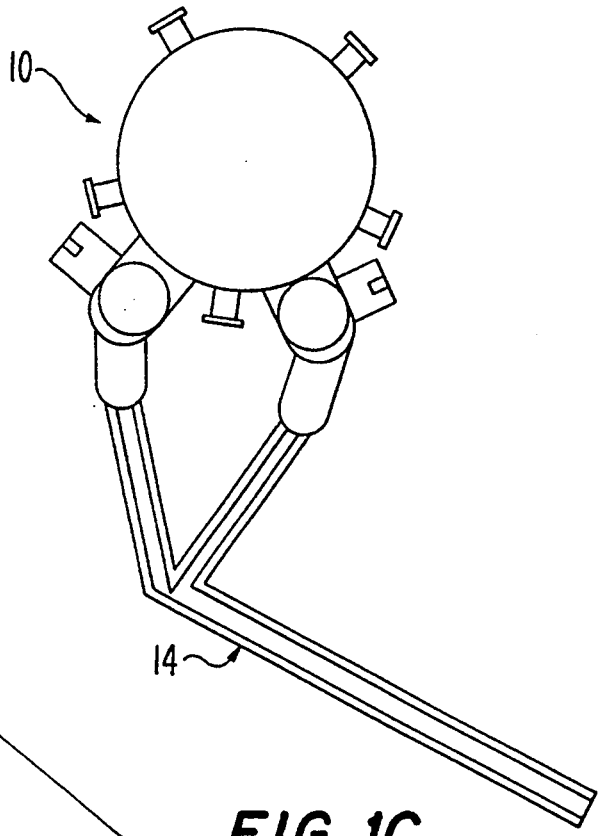
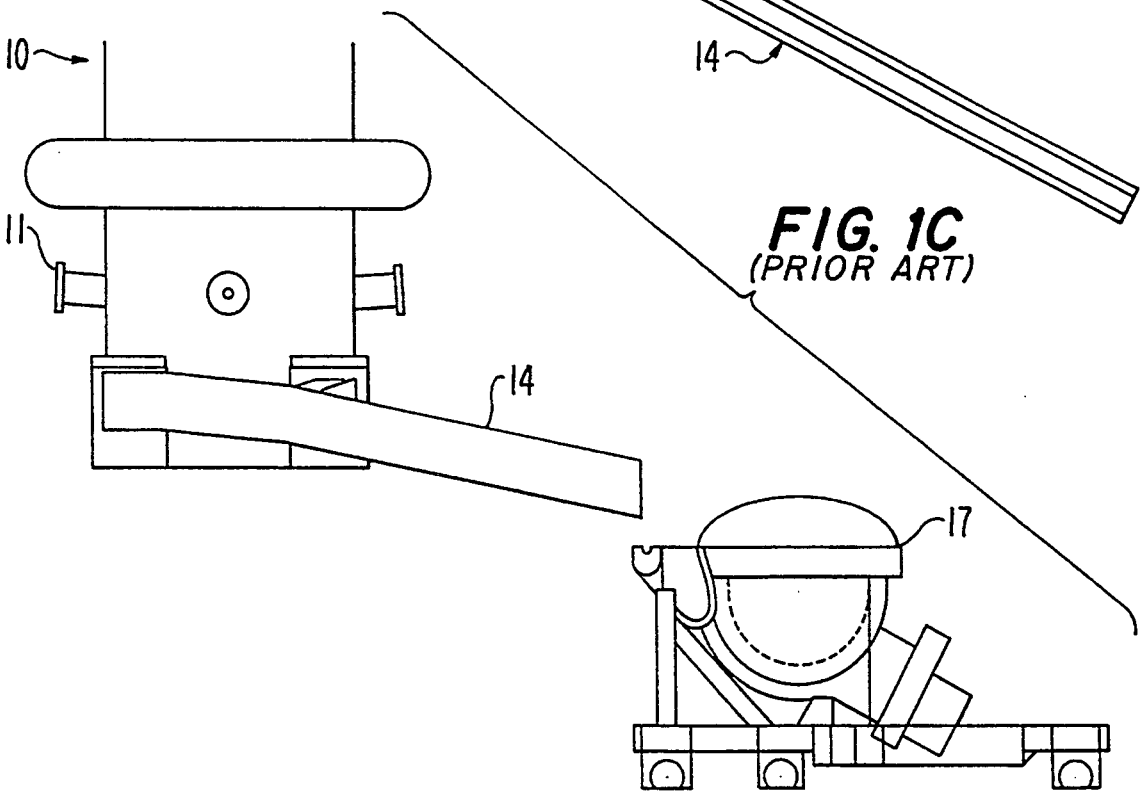
FIG. 1C
(PRIOR ART)

SLAG SEPARATOR

RELATED APPLICATIONS

This application is a continuation-in-part of U.S. Ser. No. 07/899,372, filed Jun. 16, 1992, now U.S. Pat. No. 5,246,483.

FIELD OF THE INVENTION

This invention relates to a system for separating different substances and more particularly to a cupola slag separator for separating molten slag from molten metal or alloy. Still more particularly, this invention relates to a slag separator for a dry bottom cupola used in an iron casting foundry.

BACKGROUND OF THE INVENTION

As shown in FIGS. 1A, 1B and 1C, a typical cupola 10 is a cylindrical shaft furnace that burns coke, ore or scrap steel and limestone, intensified by the blowing of air through tuyeres, shown at 11, to create a molten metal or alloy such as iron. Slags are also created along with the metal or alloy as a result of the smelting of ore. Alternate layers of ore, limestone and coke are charged into the top of the cupola. A charger is shown at 13. As the ore descends, the ore is melted by direct contact with the countercurrent flow of hot gases from the coke combustion. The resulting molten metal or alloy collects in the well of the cupola where it is discharged for use by intermittent tapping or by continuous flow. The slag, being lighter than the metal or alloy, rises to the top of the tapped mixture. The slag is skimmed off the top of the molten metal or alloy after the mixture is discharged through the tap hole.

In a dry bottom cupola, the metal or alloy and slag are not collected in the well of the cupola but are forced by blasts of air into a special vessel outside and beside the cupola to separate the slag from the metal or alloy. Such a separator is shown at 15 in FIG. 1A. Inside the separator the slag rises to the top of the molten metal or alloy. The slag is then siphoned off through a slag exit hole which is maintained about 2–3 inches higher than a metal or alloy exit hole. The conventional slag separator consists of one chamber which receives the molten metal or alloy and slag. The metal or alloy typically exits onto a launder 14 as shown in FIGS. 1B and 1C leading to a holding furnace 17 as shown in FIG. 1C.

The conventional slag separator, however, when used with a dry bottom cupola fails to remove all of the slag from the metal or alloy due to the turbulent stirring of the metal or alloy. As a result, the final product exiting from the conventional slag separator is not in a highly purified form. It is therefore a problem in the prior art to easily and completely separate metal or alloy, such as iron, from its slag.

In addition, due to the high temperature of the molten metal or alloy and slag, the conventional separator must be lined with a refractory to protect the separator against abrasion, heat and oxidation. It is a problem, however, that there is a great deal of mechanical and chemical attack on the refractory especially at the outlet from the cupola. As a result, the refractory wears out and must frequently be torn down, at least every two to five weeks, and the separator relined. This is not only costly but time consuming leading to a considerable amount of down time during which the cupola and its separator cannot be used. Thus, it is also a problem to provide a separator which does not require frequent replacement of the refractory or significant down time.

Moreover, the use of hot air to force the molten metal or alloy and slag into the separator prevents the operator from removing the top of the separator to inspect the state of the refractory and to make spot repairs. The top must remain in place to protect the operator from the hot air. Accordingly, inspection and repairs must be made when the separator is not running resulting in additional down time. Thus, it is also a problem in the prior art to provide a separator which can be opened and repaired by the operator while in use.

SUMMARY OF THE INVENTION

It is thus a general object of the present invention to provide a cupola slag separator which does not suffer from the problems and defects described above.

It is a further object of the present invention to provide a cupola slag separator which can be used with both wet and dry bottom cupolas which results in a final product of almost pure metal or alloy.

It is a further object of the present invention to provide a cupola slag separator which does not suffer from refractory erosion problems and significantly increases the time between refractory replacements.

It is a further object of the present invention to provide a cupola slag separator on which the operator is able to make spot repairs and inspections while the separator is in use.

Additional objects, advantages and novel features of the invention will be set forth in the description which follows, and will become apparent to those skilled in the art upon reading this description or practicing the invention. The objects and advantages of the invention may be realized and attained by the appended claims.

To achieve the foregoing and other objects, in accordance with the present invention, as embodied and broadly described herein, the slag separator of the present invention comprises first and second settling chambers for sequentially receiving the metal or alloy and slag mixture from a cupola and allowing the slag to rise to the top of the metal or alloy; a refractory material lining the chambers to protect the chambers from mechanical, thermal or chemical characteristics of the molten mixture; cooling means surrounding the refractory material to reduce the temperature of the refractory material and reduce the erosion of the refractory material; and means for removing the slag separated from the metal or alloy from the first and second chambers.

In use, the slag separator according to the invention is positioned adjacent a tap hole at the bottom of the cupola. An iron/slag mixture is admitted to the first settling chamber of the slag separator, where slag is skimmed off the iron. The skimmed mixture then passes beneath a chamber divided to the second settling chamber where additional slag is collected at the top of the chamber for skimming.

Preferably the slag separator is water cooled by a water cooling system including a jacket surrounding the refractory so that the refractory is preserved. Water control valves in the water cooling system control the amount of water circulated through the jacket to optimize efficiency. The separator is also preferably positioned above grade, so that the air space beneath the separator assists its cooling.

BRIEF DESCRIPTION OF THE DRAWINGS

The accompanying drawings, which are incorporated in, and form part of, the specification, illustrate an embodiment of the present invention, and together with the description serve to explain the principles of the invention. In the drawings:

FIG. 1A is a side cross-sectional view of a cupula and slag separator of the prior art.

FIG. 1B is a top plan view of the cupula of FIG. 1A.

FIG. 1C is a frontal view of the cupula of FIG. 1A with a holding furnace of the prior art.

DETAILED DESCRIPTION OF THE PREFERRED EMBODIMENT

Reference will now be made in detail to the preferred embodiment of the invention, an example of which is illustrated in the accompanying drawings.

Figure 2:
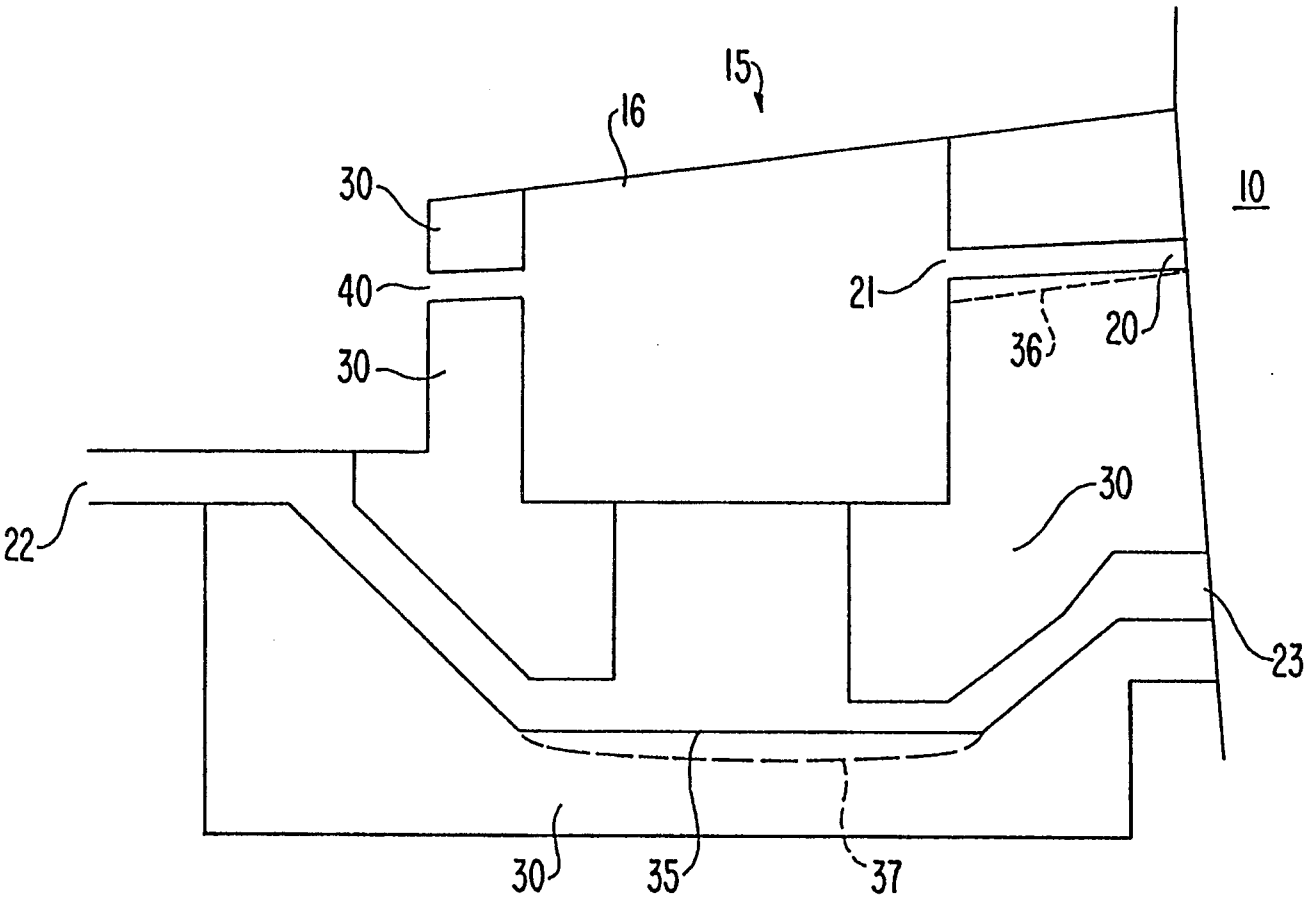
FIG. 2 (PRIOR ART)
FIG. 2 is a view of the slag separator of the prior art.
Figure 3:
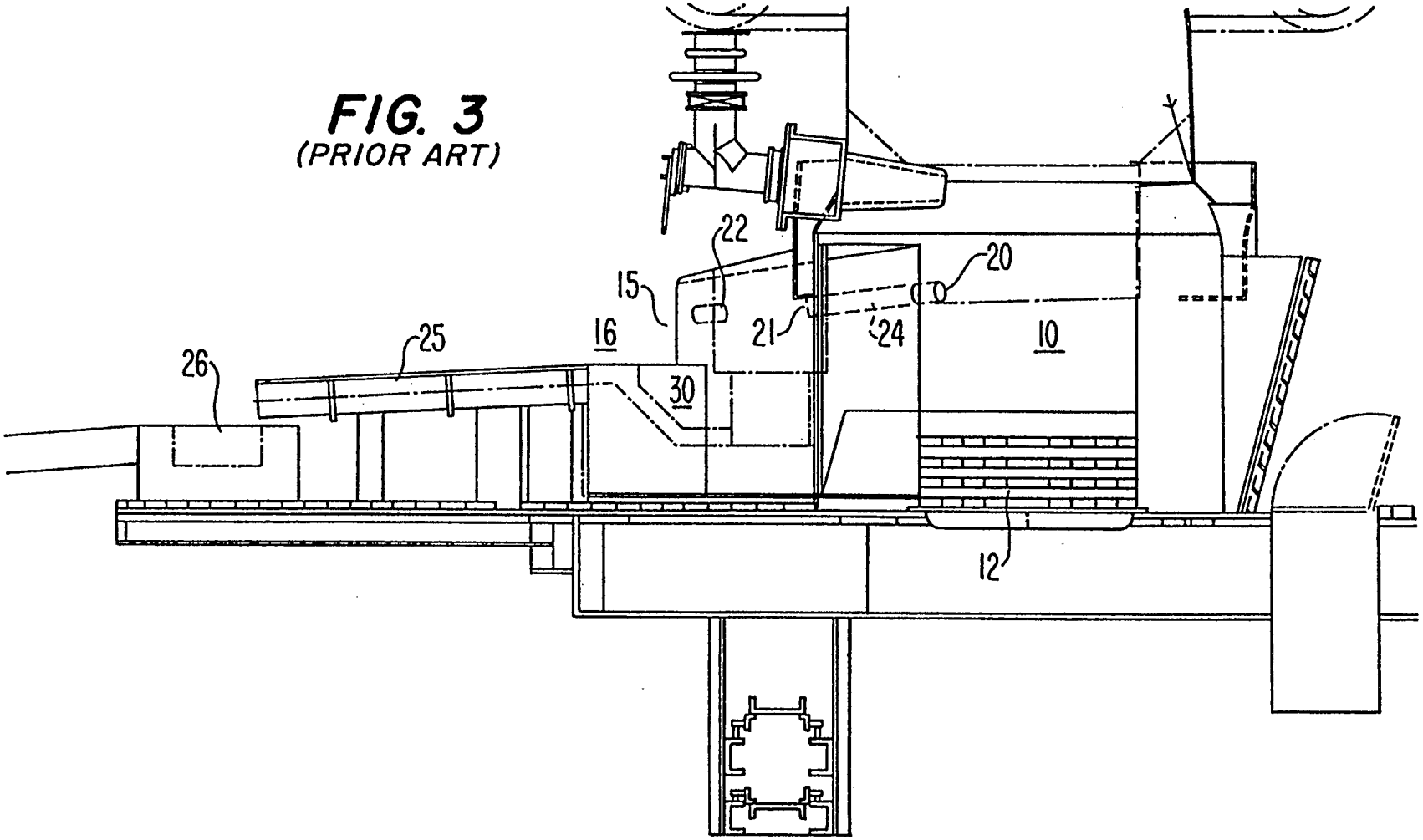
FIG. 3 (PRIOR ART)
FIG. 3 is a view of the cupola and slag separator of the prior art.

Illustrated in FIGS. 2 and 3 is the slag separator 15 of the prior art, as shown in FIG. 1A, in more detail. The base of a dry bottom cupola 10 is shown at 12. The molten metal or alloy and slag that accumulates in the base 12 of the cupola 10 during the smelting of iron ore exits the cupola through a tap hole 20 and travels through an insulated passageway 24 into the slag separator 15 at an entrance 21. The slag separator 15 is integrally formed with the base of the cupola without external cooling.

Because the molten metal or alloy is heavier than the slag, once in the separator, the slag rises to the top of the metal or alloy and flows out of the separator through a slag extraction opening 22 as the metal or alloy and slag flow through the separator 15. The molten metal or alloy exits the separator through a metal or alloy exit hole 23 to a runner 25 and then to a ladle 26. The slag extraction opening 22 is maintained higher than the metal or alloy exit hole 23 to allow the slag to flow off the top of the metal or alloy as it flows through the separator 15.

A refractory 30 lines the entire separator to protect the separator and the operator from the heat of the molten metal or alloy and slag, oxidation, and chemical attack. Erosion of the refractory occurs throughout its length due to the high temperature of the molten slag and metal and the oxidative and chemical forces acting on the separator, but is especially acute at the entrance 21 and at an area 35 at the bottom of the separator 15 due to the mechanical forces of the molten metal and slag operating on the separator at these points. These erosion points are shown at reference numerals 36 and 37 in FIG. 2. The cupola 10 is tapped at the tap hole 20 and the molten metal or alloy and slag enter the separator 15 into a chamber 16 through the entrance hole 21. The slag flows out of the separator chamber 16 through the slag exit hole 22 and metal or alloy leaves the separator chamber 16 through the metal or alloy exit hole 23. An overflow hole is also provided as shown at 40 which allows overflowing slag and metal or alloy to exit the cupola.

Figure 4:
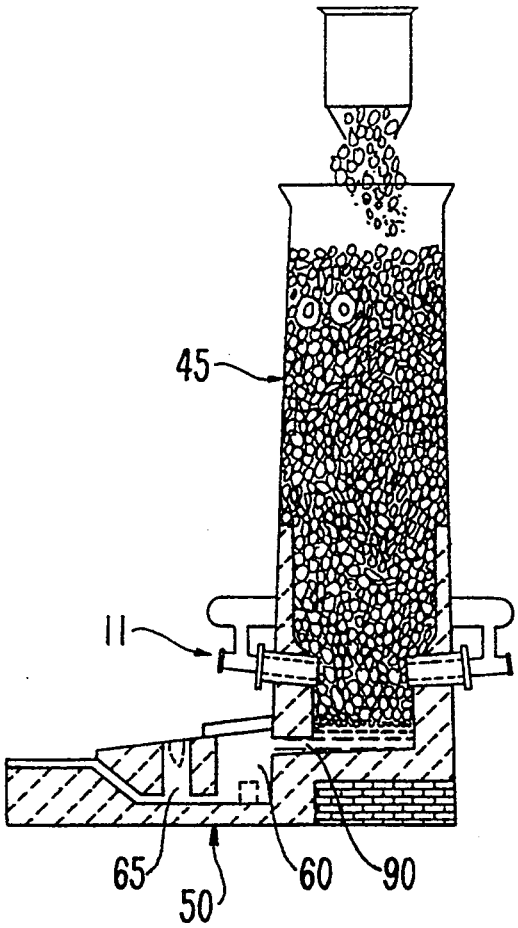
FIG. 4 is a side cross-sectional view of a cupula and the slag separator of the present invention.
Figure 5:
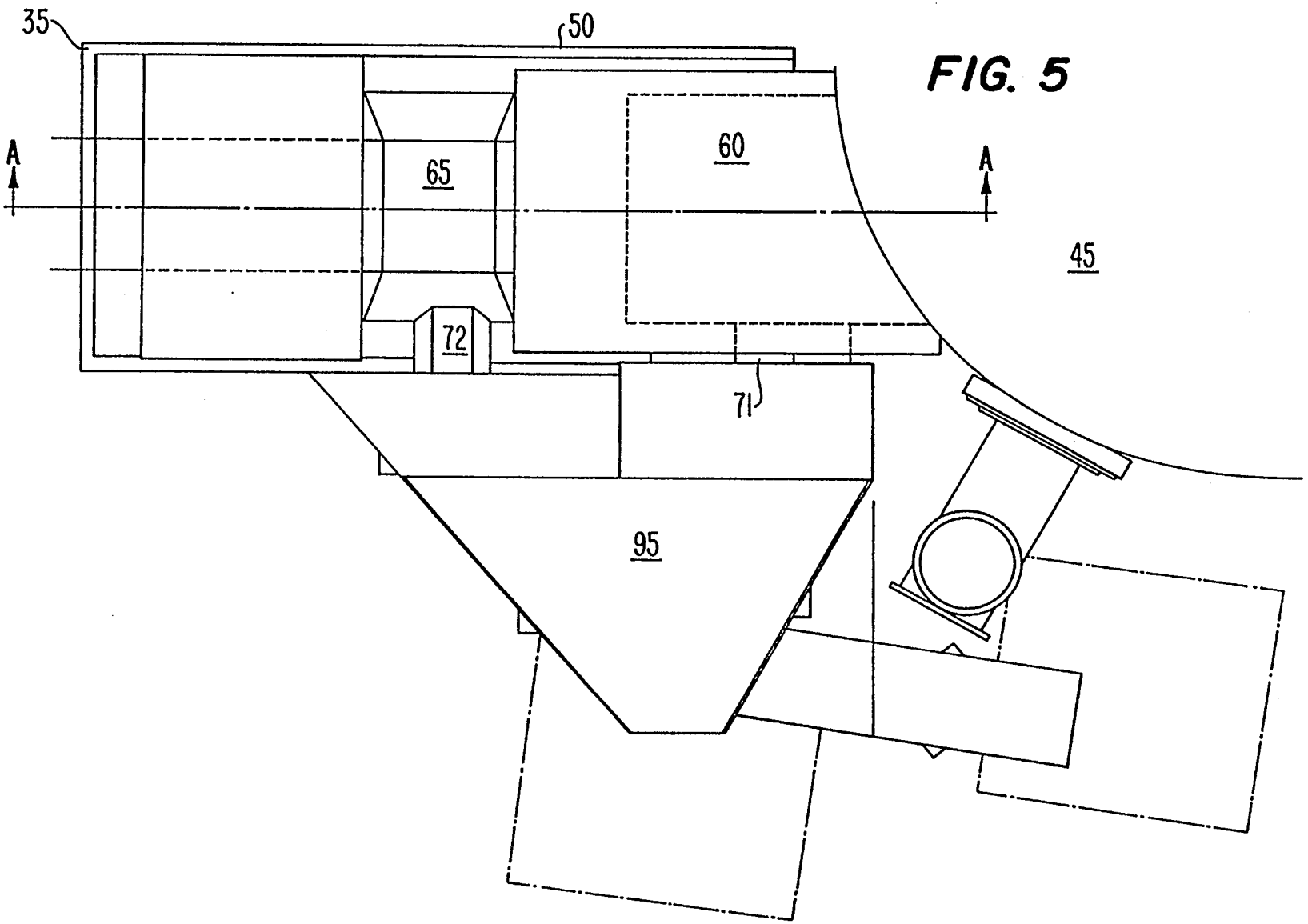
FIG. 5 is a top plan view of a cupola and the slag separator of the present invention.
Figure 6:
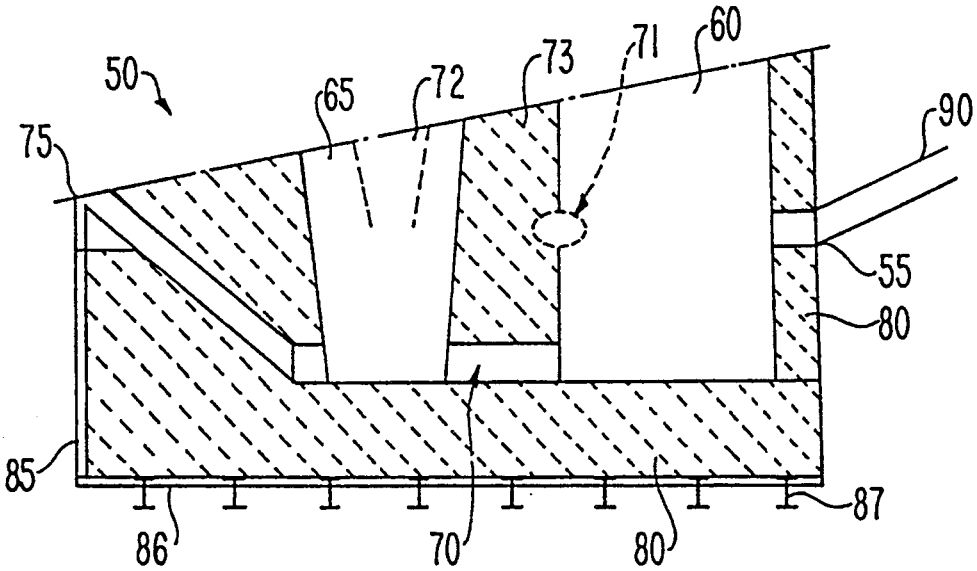
FIG. 6 is a side view of the slag separator of FIG. 3 taken along line A—A of FIG. 3.

The cupola slag separator of the present invention is illustrated in FIGS. 4, 5 and 6 at reference numeral 50. FIG. 4 shows a cross-sectional view of a cupula 45 and the separator 50 of the present invention. FIG. 5 shows a top plan view of the separator 50 of the present invention. FIG. 6 shows a side view of the separator 50 taken on line A—A of FIG. 5.

The slag separator 50 is connected to the cupola 45 by way of passageway 90 which allows the molten metal or alloy and slag mixture from the cupola to flow into a first chamber 60 of the separator 50 through an inlet 55. The separator 50 is supported by I-beams 87, or any other suitable support means, to provide a base for the separator and an air passage to allow air to pass underneath the separator to aid in cooling.

The molten metal or alloy, being heavier than the slag, settles to the bottom of the mixture and the slag rises to the top in the first chamber 60. The slag which is on top of the metal or alloy flows out of the separator through a first slag exit hole 71 to a slag conveyor 95 as the mixture flows through the separator 50. The first slag exit 71 is shown perpendicular to the inlet 55 in FIG. 6. The molten metal or alloy mixture then passes from the first chamber 60 to a second chamber 65 through a metal or alloy passageway 70. In the second chamber 65, the metal or alloy is able to settle a second time and a significant portion of any slag remaining in the mixture after the first separation rises to the top of the metal or alloy and flows out of the separator through a second slag exit 72 to the slag conveyor 95. The remaining metal or alloy which is almost entirely free of slag flows out of the separator through a metal or alloy exit 75 to a runner and ladle similar to the one shown in FIG. 3. The two separation chambers allow the slag and metal or alloy mixture to settle twice resulting in almost all of the slag being separated from the metal or alloy.

According to the principles of the invention, additional settling chambers could be used with respectively common or separate slag and iron separation.

The entire slag separator 50 including a wall 73 between the chambers 60 and 65 and paths 90, 70 and 75 is lined with a refractory 80 which can be any suitable material such as, but not limited to, fireclay brick or block. As described in connection with FIGS. 2 and 3, the refractory of the prior separators must be replaced every two to three weeks because the refractory is eroded by abrasion, heat, and oxidation. The present invention, however, solves the problems of the prior art by including a water cooling system having water cooling jackets shown at 85 and 86 in FIG. 6 surrounding the shell of the separator.

Figure 7:
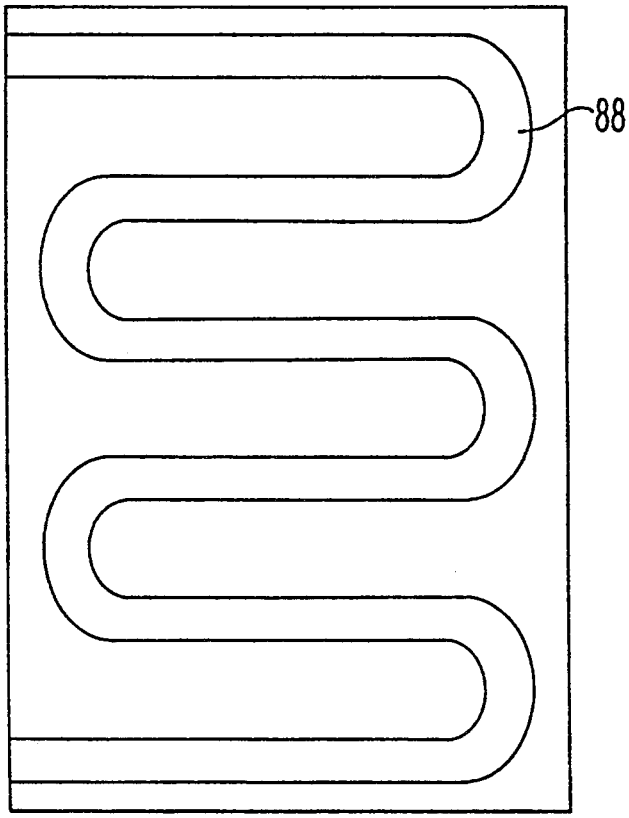
FIG. 7 is a plan view of the water cooling jacket used in the slag separator of the present invention.

A representative plan view of a water cooling jacket is shown in FIG. 7. As shown in FIG. 7 the water cooling jackets include serpentine water pipes 88, however, any suitable water cooling means or configuration could be used.

Figure 9:
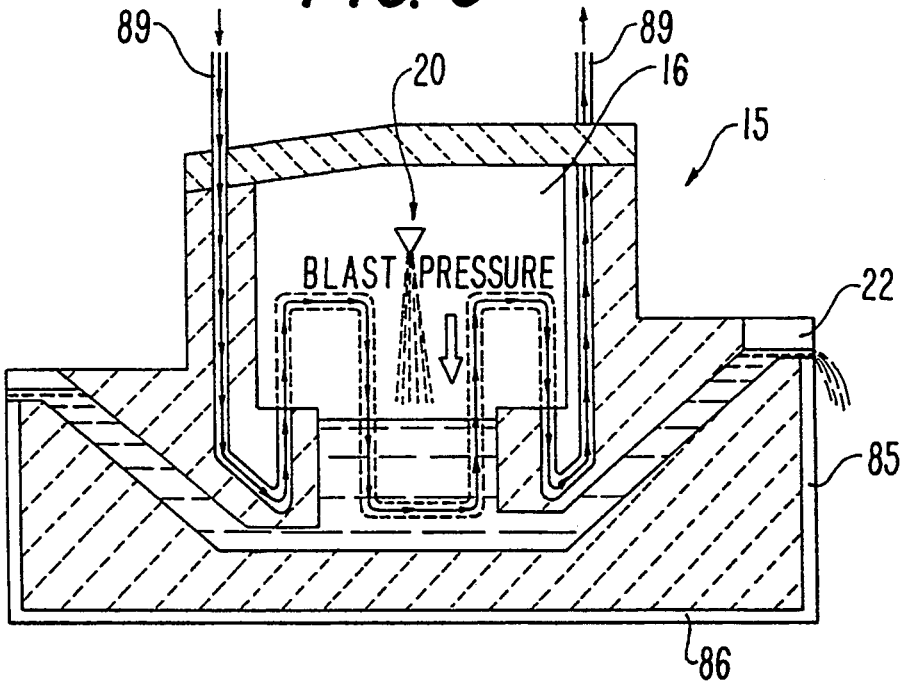
FIG. 9 is a side view of the slag separator of the prior art showing the cooling system of the present invention.
Figure 8:
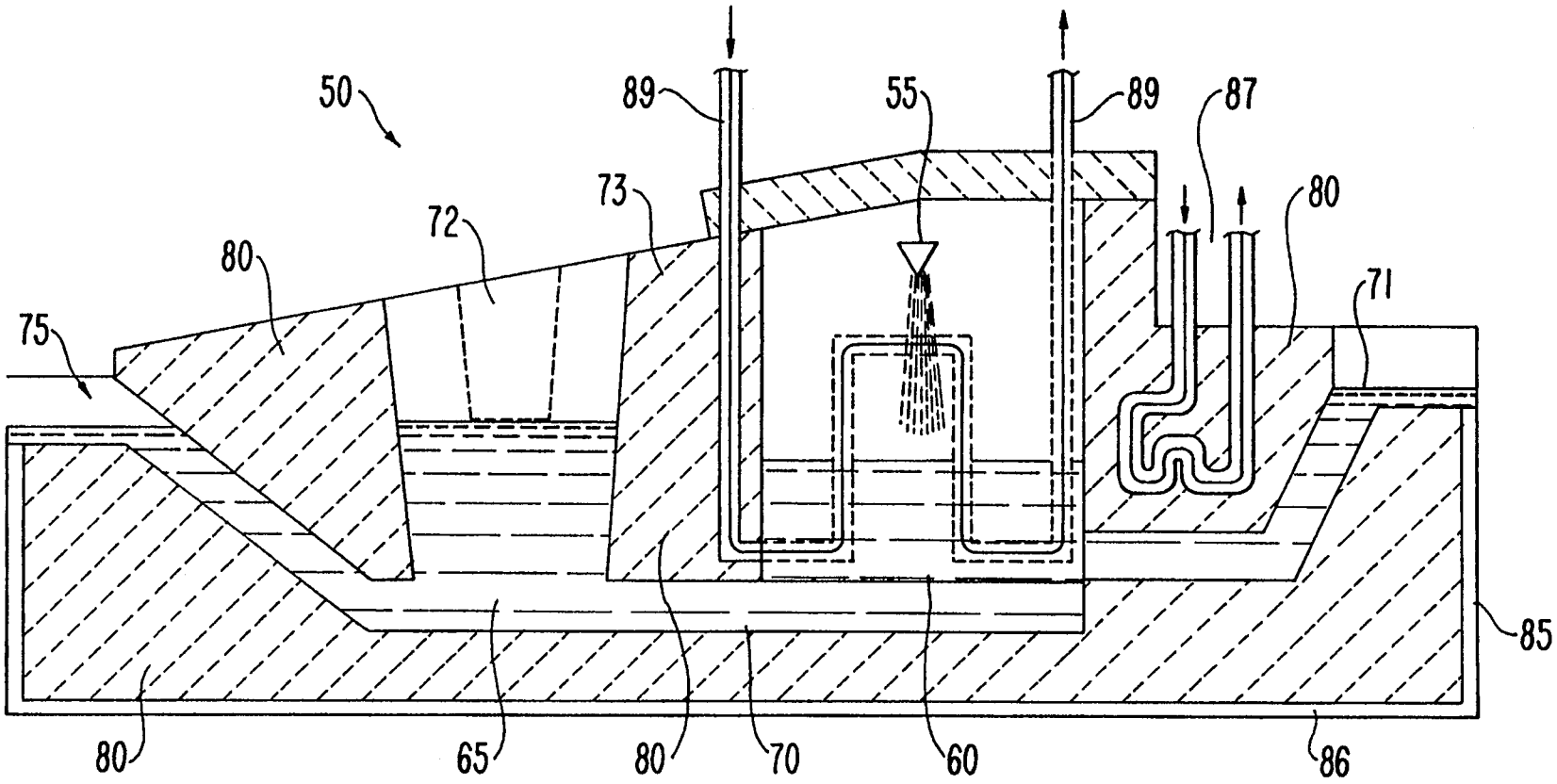
FIG. 8 is a side view of the slag separator of the present invention showing the cooling system of the present invention.

The water cooling system is illustrated in more detail in FIGS. 8, 9, 10 and 11. As shown in FIGS. 8 and 9, the water cooling system may be used in the single chamber separator 15 of the prior art as well as the dual chamber separator 50 of the present invention. In FIGS. 8 and 9, the separators 50 and 15 are illustrated with the metal or alloy and slag inlets 55 and 20 shown perpendicular to the slag exits 71 and 22. Like reference numerals in FIGS. 6 and 8 and FIGS. 2 and 9 denote like features and thus will not be discussed in detail.

In the embodiments illustrated in FIGS. 8 and 9, the water cooling jackets 85 and 86 surrounding the shell of the separator are shown. In addition, a water cooling jacket 89 may surround the separation chambers 60 and 16 as shown in solid and dashed line in FIGS. 8 and 9, respectively. Further, a water cooling jacket may be used between the first chamber 60 and the first slag exit 71 as shown at 87 in FIG. 8. Although not shown, a similar water cooling jacket 87 could be used in the separator 15 shown in FIG. 9. Likewise, the second chamber 65 shown in FIG. 8 could also be surrounded by a water cooling jacket so long as the chamber 65 is kept hot enough to avoid freezing. The jackets 87 and 89 are shown having water circulating therethrough and the direction of water flow is shown by the arrows.

Figure 10:
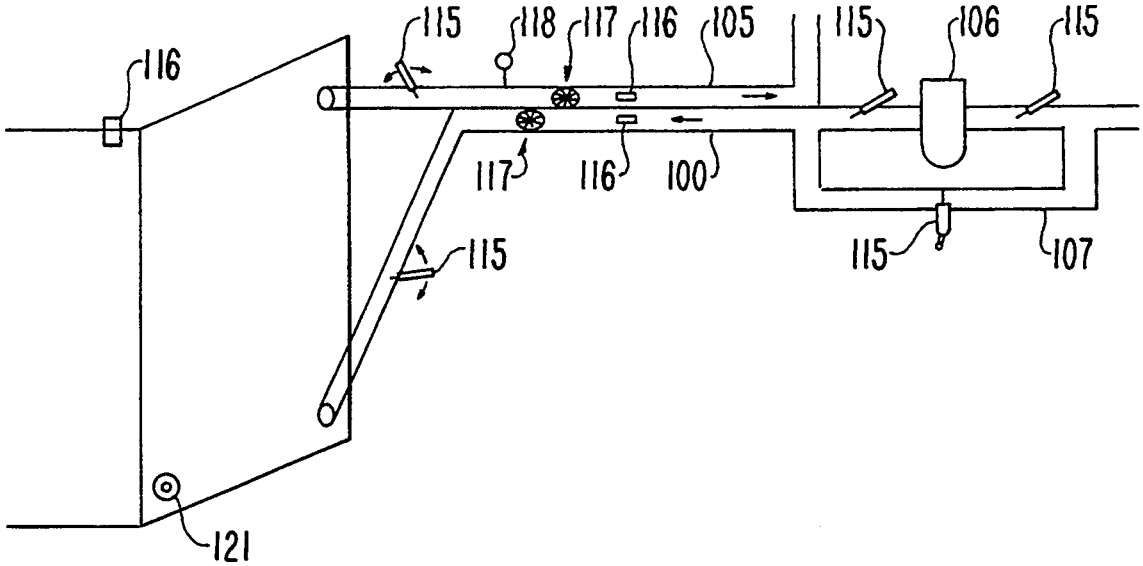
FIG. 10 is a schematic view of one embodiment of the cooling system of the present invention.
Figure 11:
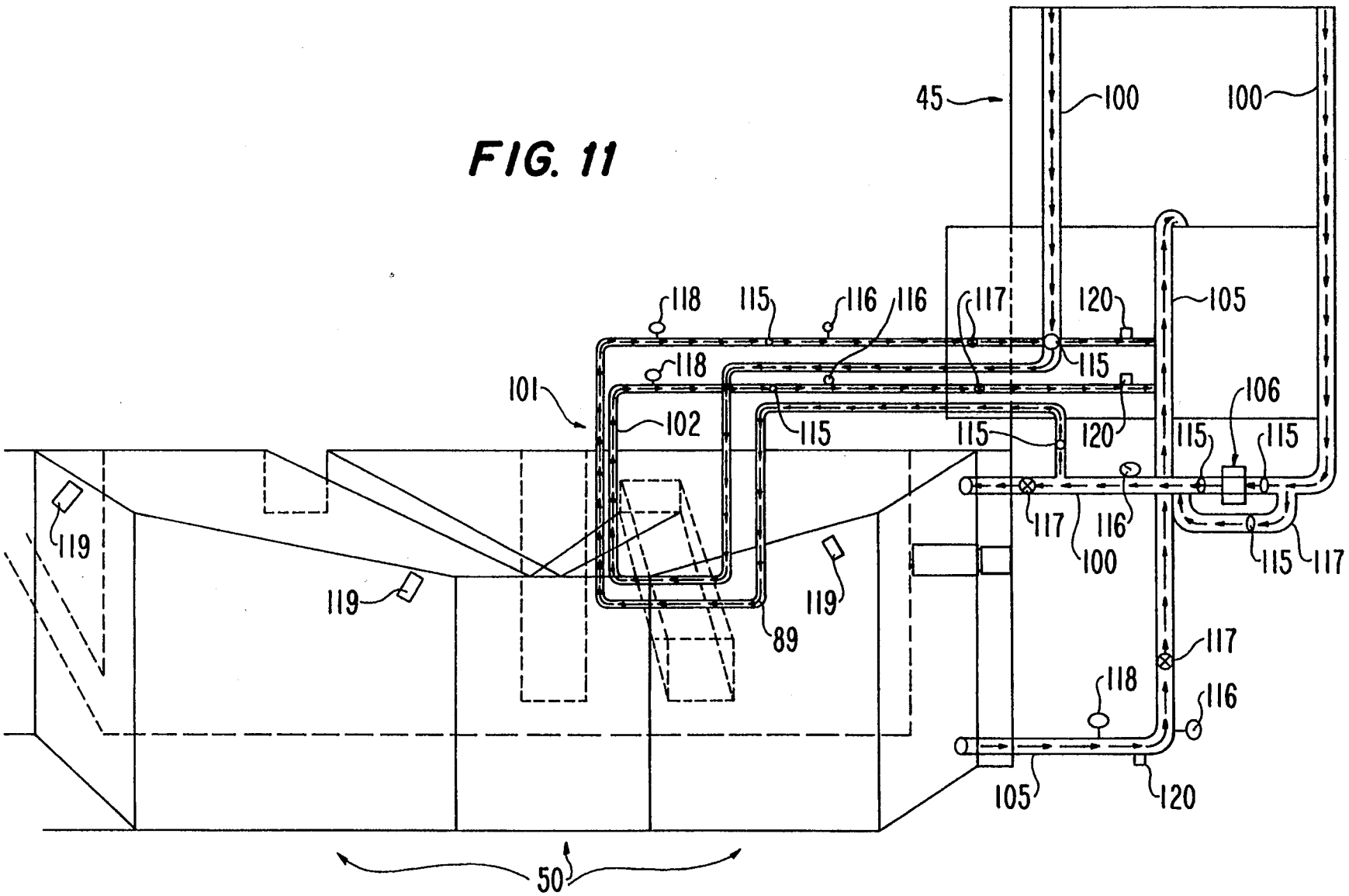
FIG. 11 is a schematic view of another embodiment of the cooling system of the present invention.

The water supply and return lines of the water cooling system for separator 50 are shown in FIGS. 10 and 11. Water is recirculated through the water cooling system through supply lines 100 for supplying water from the water source (not shown) to the water cooling jackets and through return lines 105 for returning the water from a water cooling jackets to a water reservoir or cooler (not shown). FIG. 10 illustrates the supply and return lines 100 and 105 supplying and returning water to the water cooling jackets 85 and 86 (not shown) in the separator shell. FIG. 11 illustrates the relationship between the water cooling system and the cupola 45 and the separator 50 and shows the supply and return lines 100 and 105 supplying and returning water to the water cooling jacket 89 surrounding the first separation chamber 60 as well as jackets 85 and 86 in the separator shell (not shown). Although not shown in FIG. 11, water supply and return lines could also be provided for recirculating water through the jacket 87 between the first separation chamber 60 and the slag exit 71.

As shown in FIG. 11, the jacket 87 includes an inner line 101 and an outer line 102. Preferably, the supply and return lines 100 and 105 service the lower and upper part of the separator shell, respectively, as shown in FIG. 10. However, the supply and return lines 100 and 105 may also service the upper and lower part of the separator, respectively, as shown in FIG. 11. The direction of the flow of water in the water cooling system is shown by the arrows within the water line. The water lines may be pipes made from copper or any other suitable material. In order to remove water from the water cooling jackets after the water source has been cut off, a drain hole 121 may be provided in the separator 50.

The water cooling system also includes a water filter 106 in the water supply line 100 for filtering water recirculated through the water cooling system. The water filter 106 can be any suitable water filter such as a screen filter. In the case of an emergency, however, a bypass 107 controlled by water control valves 115 is provided for bypassing the filter 106.

The water control valves 115 are also placed in the water lines throughout the water control system to regulate the volume of water circulated through the jackets and slag separator shell in order to optimize the efficiency of the system by controlling the amount of cooling. The valves 115 can be ball valves or any other suitable water flow regulating valve. Flow meters 117 in the water lines 100 and 105 allow for the visible inspection of water flow.

The efficiency of the water cooling system may also be maximized by placing temperature sensors 116 for monitoring the water temperature throughout the water cooling system. By monitoring the water temperature the water flow can be regulated for maximum efficiency.

The water pressure in the water cooling system may be monitored by pressure gauges 118. Normally, the pressure in the inner line 101 is 20 psi and the pressure in the outer line 102 is 40 psi, but the pressure may vary depending on the particular system and whether the water flows through the water filter 106 or through the bypass 107. The water circulating throughout the water cooling system can also be regulated in response to the pressure gauges 118 to maximize efficiency.

Pressure relief valves 119 may be provided throughout the water cooling system for venting steam or air under high pressure which could build up in the water cooling system and cause damage to the system or the operator.

Check valves 120 may also be provided throughout the water cooling system to allow for the addition of other monitoring equipment. The check valves 120 can operate as pressure relief valves but are also constructed, such as by means of threading, to receive additional equipment such as electronic flow controls which could automatically shut off the water if required.

Figure 12:
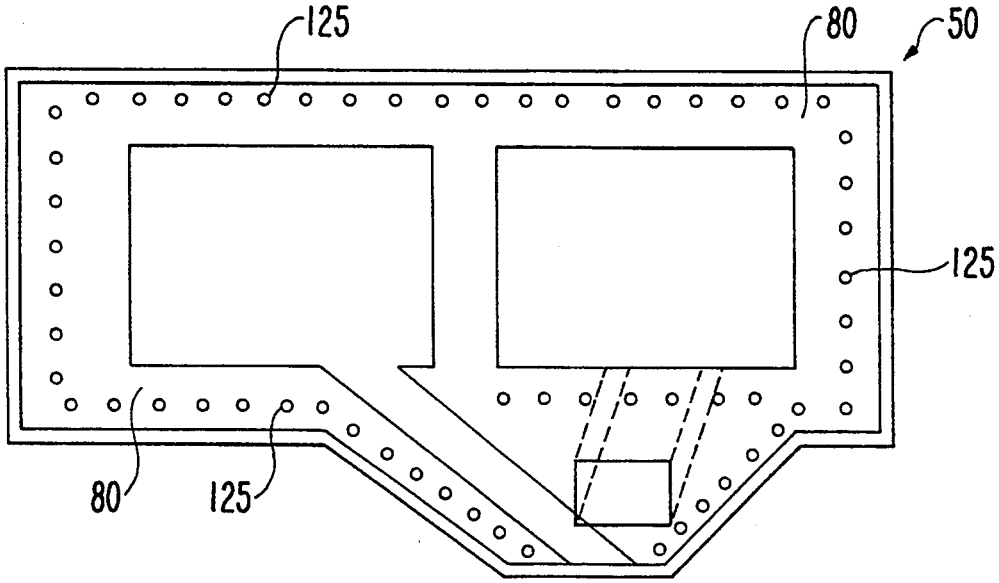
FIG. 12 is a side view of the slag separator of the present invention showing the venting system of the present invention.

The water cooling system of the present invention also preferably includes means to prevent any water which could possibly leak from the water cooling system from reaching the molten material in the separator. As shown in FIG. 12, such means includes vent holes 125 in the refractory 80 between the water cooling jackets and the iron. If water were to leak from the water cooling system it would exit the separator via the vent holes 125 before reaching the molten material within the separator. The vent holes 125 may be created by placing hollow pipes in the refractory during a reline and then removing the pipes afterwards.

The water cooling jackets on each of the side surfaces and the bottom surface, surrounding the separation chambers and between the first chamber and slag exit keep the refractory lining cooler thereby greatly reducing the amount of erosion found in non-cooled systems and increasing refractory life. The refractory cooled by the water cooling jackets 85, 86, 87 and 89 of the present invention need not be replaced sooner than twenty weeks as opposed to two to three weeks in the prior systems.

In addition, the water cooling jackets 85, 86, 87 and 89 keep the outside of separator sufficiently cool to the touch and prevents operators or others from being burned by contact with the separator. The jackets 85, 86, 87 and 89 are able to operate with fresh or recycled water. Although not necessary to extending the life of the refractory, the reduced temperature of the refractory caused by the water cooled jackets additionally causes slag to solidify on the inside layer of the refractory thereby further insulating the refractory and extending refractory life.

In the present invention, the molten metal or alloy and slag travels through the separator 50 under the force of gravity. The inlet 55 is attached to cupola tap hole through passageway 90. The passageway is sloped at such an angle so as to allow the force of gravity and the weight of the molten material to drive the material through the separator. The sloped passageway 90 eliminates the need to utilize blasts of hot air to facilitate a flow of the molten materials from the cupola through the slag separator 50. Because this system does not use blasts of hot air, the operator can remove the top of the separator and the passageway to make spot repairs and inspections while the cupola and separator are in operation.

The separator 50, while shown in conjunction with a dry bottom cupola, can also be used with a wet bottom cupola. In addition the separator can be used with a cupola that is tapped either continuously or intermittently.

The foregoing description of a preferred embodiment of the invention has been presented for purposes of illustration and description. It is not intended to be exhausted or to limit the invention to the precise form disclosed. Many modifications and variations are possible in light of the above teaching. The embodiment was chosen and described in order to best explain the principles of the invention and its practical application to thereby enable others skilled in the art to best utilize the invention and various embodiments and with various modifications as are suited to the particular use contemplated. It is intended that the scope of the invention only be limited by the claims appended hereto.

I claim:

1. A slag separator for receiving a molten metal or alloy and slag mixture from a cupola and separating the metal or alloy from the slag, comprising:

a settling means comprising at least one chamber for receiving said molten metal or alloy and slag mixture from said cupola;

a refractory material lining said chamber to protect said chamber from mechanical, thermal, or chemical characteristics of said molten mixture;

fluid cooling means surrounding said refractory material to reduce the temperature of said refractory material to reduce the erosion of the refractory material caused by the mechanical, thermal, or chemical characteristics of the molten mixture; and means for separating said metal or alloy from said slag.

2. A slag separator as defined in claim 1, wherein said fluid cooling means comprises:

a water supply means;

water conduits surrounding the refractory to receive cool water from said water supply means to cool the refractory; and a water return means to receive water from said water conduits for recirculation to said water supply.

3. A slag separator as defined in claim 1, further comprising a fluid control means to control the volume of fluid supplied to the fluid cooling means to optimize efficiency.

4. A slag separator as defined in claim 3, further comprising a temperature sensing means in said fluid cooling means to monitor the temperature of said fluid in said fluid cooling means, said fluid control means being able to control the volume of said fluid in response to said temperature sensing means in order to maximize efficiency.

5. A slag separator as defined in claim 4, further comprising a flow meter in said fluid cooling means to allow a visible inspection of water flow.

6. A slag separator as defined in claim 5, including means for monitoring a pressure of fluid in said fluid cooling means.

7. A slag separator as defined in claim 6, further comprising pressure relief means for venting pressurized fluid in said fluid cooling means.

8. A slag separator as defined in claim 6, including means to regulate the flow of water in response to said pressure monitoring means.

9. A slag separator as defined in claim 8, further comprising a drain hole for removing fluid from said fluid cooling means after the fluid source has been shut off.

10. A slag separator as defined in claim 9, further comprising a fluid filter to filter the fluid in the fluid cooling means.

11. A slag separator as defined in claim 10, further comprising a fluid bypass means for allowing fluid to bypass said filter in an emergency.

12. A slag separator as defined in claim 1, wherein said refractory material further includes venting channels embedded there to vent any fluid which were to leak from said fluid cooling means.

13. A slag separator as defined in claim 1, wherein said separator is supported by a frame which provides an air passage under the separator to aid in cooling.

14. A slag separator as defined in claim 11, wherein said separating means comprises:

a first chamber in said settling means for receiving said metal or alloy and slag from said cupola in which said metal or alloy is primarily separated from said slag by allowing said slag to rise up through said metal or alloy;

a second chamber in said settling means for receiving said metal or alloy from said first chamber in which slag remaining in said metal or alloy after said primary separation is finally separated from said metal or alloy by allowing the unseparated slag remaining in said metal or alloy to rise up through said metal or alloy; and a passageway connecting said first and second chambers.

15. A slag separator for receiving a molten metal or alloy and slag mixture from a cupola and separating the metal or alloy from the slag, comprising:

a settling means comprising at least one chamber for receiving said molten metal or alloy and slag mixture from said cupola;

a refractory material lining said chamber to protect said chamber from mechanical, thermal, or chemical characteristics of said molten mixture;

fluid cooling means surrounding said refractory material to reduce the temperature of said refractory material to reduce the erosion of the refractory material caused by the mechanical, thermal, or chemical characteristics of the molten mixture;

pressure monitoring means for monitoring the pressure of fluid in said fluid cooling means; and means for separating said metal or alloy from said slag.

16. A slag separator as defined in claim 15, wherein said fluid cooling means comprises:

a water supply means;

water conduits surrounding the refractory to receive cool water from, said water supply means to cool the refractory; and a water return means to receive water from said water conduit for recirculation to said water supply.

17. A slag separator as defined in claim 15, further comprising a fluid control means to control the volume of fluid supplied to the fluid cooling means to optimize efficiency.

18. A slag separator as defined in claim 17, wherein said fluid control means controls the fluid in response to said pressure monitoring means.

19. A slag separator as defined in claim 17, further comprising a temperature sensing means in said fluid cooling means to monitor the temperature of said fluid in said fluid cooling means, said fluid control means being able to control the volume of said fluid in response to said temperature sensing means in order to maximize efficiency.

20. A slag separator as defined in claim 19, further comprising a flow meter in said fluid cooling means to allow the visible inspection of water flow.

21. A slag separator as defined in claim 15, further comprising pressure relief means for venting pressurized fluid in said fluid cooling means.

22. A slag separator as defined in claim 20, further comprising a drain hole for removing fluid from said fluid cooling means after the fluid source has been shut off.

23. A slag separator as defined in claim 22, further comprising a fluid filter to filter the fluid in the fluid cooling means.

24. A slag separator as defined in claim 23, further comprising a fluid bypass means for allowing fluid to bypass said filter in an emergency.

25. A slag separator as defined in claim 15, wherein said refractory material further includes venting channels embedded there to vent any fluid which were to leak from said fluid cooling means.

26. A slag separator as defined in claim 15, wherein said separator is supported by a frame which provides an air passage under the separator to aid in cooling.

27. A slag separator as defined in claim 15, wherein said separating means comprises:

a first chamber in said settling means for receiving said metal or alloy and slag from said cupola in which said metal or alloy is primarily separated from said slag by allowing said slag to rise up through said metal or alloy;

a second chamber in said settling means for receiving said metal or alloy from said first chamber in which slag remaining in said metal or alloy after said primary separation is finally separated from said metal or alloy by allowing the unseparated slag remaining in said metal or alloy to rise up through said metal or alloy; and a passageway connecting said first and second chambers.

28. A process for separating molten metal or alloy from a mixture of molten metal or alloy and slag emanating from a cupola, comprising the steps of:

providing a slag settling means with at least one chamber for receiving said molten metal or alloy and slag mixture from said cupola, said chamber being lined with a refractory material to protect said chamber from mechanical, thermal, or chemical characteristics of said mixture;

providing a slag separator means for separating said metaor alloy from said slag;

directing said molten mixture of metal or alloy and slag from said slag settling means into said slag separating means;

cooling said refractory material lining said chamber to reduce the erosion of the refractory material caused by the mechanical, thermal, or chemical characteristics of the molten mixture;

separating said metal or alloy from said slag;

removing said slag from said separating means; and removing said metal or alloy from said separating means.

29. The process defined in claim 28, wherein the said mixture is directed into said settling means under the force of gravity.

30. The process defined in claim 29, wherein said cooling of said refractory is by a fluid cooling means.

31. The process defined in claim 30, further including the step of monitoring the flow of fluid in the fluid cooling means to optimize efficiency.

32. The process defined in claim 30, further including the step of monitoring the temperature of the fluid.

33. The process defined in claim 32, further comprising the step of regulating the fluid flow in the fluid cooling means in response to the temperature sensing step to maximize efficiency.

34. The process defined in claim 30, further comprising the step of monitoring the pressure of the fluid in the water cooling system.

35. The process defined in claim 30, further comprising the step of venting any fluid which leaks from the fluid cooling system from the refractory before it leaks into the settling means.

* * * * *